US005146077A

United States Patent [19]

Caserta et al.

[11] Patent Number: 5,146,077

[45] Date of Patent: Sep. 8, 1992

[54] GATED VOLTAGE APPARATUS FOR HIGH LIGHT RESOLUTION AND BRIGHT SOURCE PROTECTION OF IMAGE INTENSIFIER TUBE

[75] Inventors: Joseph N. Caserta; William D. Mims; David A. Crenshaw, all of Roanoke, Va.

[73] Assignee: ITT Corporation, New York, N.Y.

[21] Appl. No.: 671,344

[22] Filed: Mar. 19, 1991

[51] Int. Cl.[5] ..... H01J 31/50

[52] U.S. Cl. ..... 250/213 VT; 313/537

[58] Field of Search ..... 250/213 VT; 313/537; 302/311; 315/307

[56] References Cited

U.S. PATENT DOCUMENTS

| | | | |
|---|---|---|---|
| 3,694,659 | 9/1972 | Ramsay et al. | 250/213 VT |
| 3,739,178 | 6/1973 | Chow | 250/213 VT |
| 4,134,009 | 1/1979 | Dippold | 250/213 VT |
| 4,195,222 | 3/1980 | Fouilloy | 250/213 VT |
| 4,882,481 | 11/1989 | Gilligan et al. | 250/213 VT |
| 4,952,793 | 8/1990 | Cantrell et al. | 250/213 VT |

*Primary Examiner*—Janice A. Howell
*Assistant Examiner*—Kiet T. Nguyen
*Attorney, Agent, or Firm*—Arthur L. Plevy; Patrick M. Hogan

[57] ABSTRACT

A bright source protection circuit for an image intensifier tube modulates the voltage supplied to the tube's photocathode in response to current drawn by the photocathode such that the photocathode is pulsed on and off until the desired photocathode current is achieved.

15 Claims, 2 Drawing Sheets

GATED VOLTAGE APPARATUS FOR HIGH LIGHT RESOLUTION AND BRIGHT SOURCE PROTECTION OF IMAGE INTENSIFIER TUBE

FIELD OF THE INVENTION

This invention relates in general to apparatus for high light resolution and bright source protection of image intensifier tubes and in particular to a bright source protection circuit that is pulse width modulated.

BACKGROUND OF THE INVENTION

Image intensifiers are well known for their ability to enhance night-time vision. The image intensifier multiplies the amount of incident light received by it to produce a signal that is bright enough for presentation to the eyes of a viewer. These devices, which are particularly useful for providing images from dark regions, have both industrial and military application. The U.S. military uses image intensifiers during night-time operations for viewing and aiming at targets that otherwise would not be visible. Night radiation is reflected from the target, and the reflected energy is amplified by the image intensifier. As a result, the target is made visible without the use of additional light. Other examples include using image intensifiers for enhancing the night vision of aviators, for providing night vision to sufferers of retinitis pigmentosa (night blindness), and for photographing astronomical bodies.

A typical image intensifier includes an objective lens, which focuses visible and infrared radiation from a distant object onto a photocathode. The photocathode, a photoemissive wafer that is extremely sensitive to low-radiation levels of light in the 580–900 nm spectral range, provides an emission of electrons in response to the electromagnetic radiation. This photo response is non-linearly related to the voltage at the photocathode (see FIG. 1, for example). Electrons emitted from the photocathode are accelerated towards a phosphor screen (anode), which is maintained at a higher positive potential than the photocathode. The phosphor screen converts the electron emission into visible light. An operator views the visible light provided by the phosphor screen.

Brightness of the image is increased by placing a microchannel plate (MCP) between the photocathode and phosphor screen. A thin glass plate having an array of microscopic holes through it, the MCP increases the density of the electron emission. Each electron impinging on the MCP results in the emission of a number of secondary electrons which, in turn, causes the emission of more secondary electrons. Thus, each microscopic hole acts as a channel-type secondary emission electron multiplier having a gain of up to several thousand. The electron gain of the MCP is controlled primarily by the potential difference between its input and output planes.

Two such image intensifiers tubes, the GEN II Image Intensifier Tube and a GEN III Image Intensifier Tube, are manufactured by ITT Electro Optical Products division, in Roanoke, Va. The GEN II Image Intensifier Tube employs an alkaline photocathode, whose potential varies roughly one volt. Depending on input light level, in the GEN III image Intensifier Tube, the photocathode is made of Gallium Arsenide. Unlike the alkaline photocathode of the GEN II tube, the Gallium Arsenide photocathode of the GEN III tube is susceptible to being bombarded by the positive ions from the MCP. To prevent this bombardment, the MCP is coated with a film of aluminum oxide.

A bright source can degrade the resolution of an image intensifier tube. Resolution of the tube is based upon its ability to resolve line pairs. When the tube goes to high light, the MCP increases the flow of electrons. Some channels in the MCP may become saturated, in which event resolution is degraded. If the source becomes brighter; the photocathode emits a greater number of electrons (i.e. the photocathode draws additional current). As a result of the MCP gain, more channels become saturated and the resolution is further degraded. The resolution of a bright source at high light becomes unacceptable.

Bright source protection circuits are employed to improve the resolution of an image at high light. In the GEN II tube, for instance, the photo response of the photocathode is reduced as the source becomes brighter. The bright source protection circuit includes a dropping resistor that is connected between the photocathode and a voltage multiplier, which provides an operating potential to the photocathode. As the current drawn by the photocathode increases, the voltage drop across the dropping resistor also increases. The potential supplied to the photocathode is lowered, and the photocathode provides a lower current in response to the bright input light. Thus, the photo response of the photocathode is automatically reduced and although the resolution is greatly reduced, the high light range of the GEN II image intensifier tub is increased.

This prior art bright source protection circuit cannot be employed for the GEN III tube. Whereas the voltage to the GEN II photocathode can be dropped to 1 volt out of 250, the voltage cannot be dropped to one volt for the GEN III photocathode. This is due to the aluminum oxide film on the MCP. Electrons emitted from the cathode must have sufficient energy to penetrate the aluminum oxide film; otherwise, the tube goes out. The voltage required to penetrate the aluminum oxide film is defined as the tube clamp voltage. Therefore, if the photocathode voltage is lower than the tube clamp voltage, the electrons from the photocathode cannot penetrate the aluminum oxide film, and the tube goes out.

To prevent the GEN III image intensifier tube from going out, the photocathode voltage is clamped at a level above the tube clamp voltage. The dropping resistor is connected between the voltage multiplier and the photocathode. The anode of a diode is connected to the input terminal of the photocathode, and the cathode of the diode is connected to a source that provides a power supply clamp voltage. The current drawn by the photocathode is increased until the cathode voltage reaches the power supply clamp voltage, whereupon the diode becomes forward biased. As a result, the cathode voltage is maintained at the power supply clamp voltage.

This circuit is difficult to implement in practice, however, since the tube clamp voltage is not always known. The tube clamp voltage is dependant upon the thickness and conductivity of the aluminum oxide film, which is dependant upon the manufacturing process. Thus, the thickness and conductivity varies with each tube. In a sample of GEN III tubes, the tube clamp voltage has a normal distribution curve with a mean of eighteen volts and a standard deviation of four volts. To avoid rejecting tubes during construction (i.e. to accommodate as many tubes as possible), the power supply clamp voltage is selected at 40 volts. If, however, the image intensifier tube has a tube clamp voltage of 10 volts, the photocathode will emit more electrons than the rest of the tube can handle. As a result, electrons pile up on the aluminum oxide film of the MCP and resolution at the phosphor screen is degraded. Thus, the problem of relying solely on the power supply clamp voltage—due to tube construction—is apparent.

Therefore, it is an object of the present invention to provide a bright source protection circuit that varies the photocathode voltage in response to current drawn by the photocathode.

It is a still further object of the present invention to provide a bright source protection circuit that pulse width modulates the photocathode voltage such that the tube is pulsed on and off.

SUMMARY OF THE INVENTION

In an image intensifier tube having a photocathode, which draws a current in response to the brightness of input light, the improvement therewith comprises pulsing means, which pulse the photocathode on and off in response to the magnitude of current drawn by the photocathode.

DETAILED DESCRIPTION OF THE FIGURES

The present invention can be used as a bright source protection circuit for any type of image intensifier tube. In the following paragraphs, however, the present invention will be described in connection with the GEN III image intensifier tube.

In the GEN III image intensifier tube, operating potentials are provided to the photocathode, MCP and phosphor screen by first, second and third voltage multipliers, respectively. Each voltage multiplier takes an alternating current of 260 to 800 volts pk-pk through a series of cascaded voltage doublers. The first voltage multiplier supplies an operating potential of −1600 v (−1.6 kV) to the photocathode. The second multiplier supplies a potential of −800 volts to the input plane of MCP. The output plane of the MCP is grounded and the third voltage multiplier supplies a potential of +6 kV to the phosphor screen.

Figure 1:
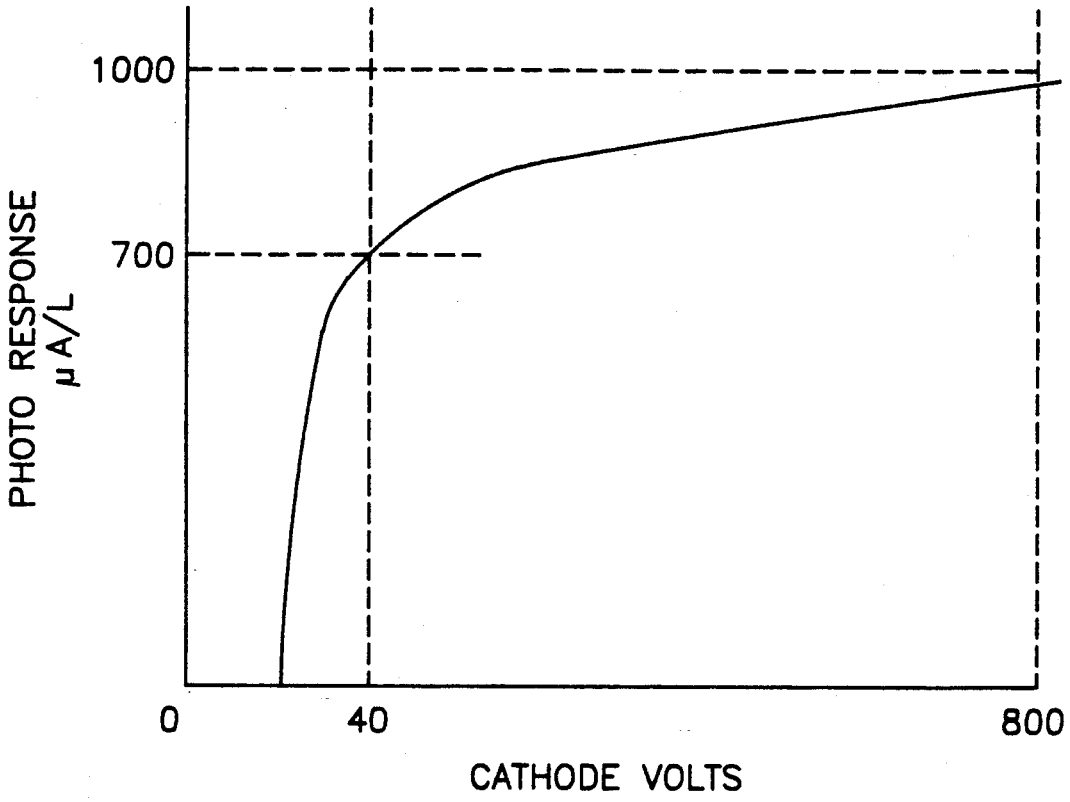
FIG. 1 is a graph of photo response versus photocathode voltage for a Gallium Arsenide photocathode in a GEN III image intensifier tube.

Referring now to FIG. 1, there is shown a graph of the photo response of a gallium arsenide photocathode for a GEN III image intensifier tube. The abscissa is the photocathode voltage and the ordinate is the photo response of the photocathode, in microamperes per lumen. Clearly, the photo response is non-linear For this particular image intensifier tube, the photo response is zero when the potential difference is less than 20 volts. Thus, the tube clamp voltage is 20 volts. The photocathode voltage is 800 volts, at which voltage the photo response is approximately 1000 microamps per lumen. In an unprotected GEN III image intensifier tube, the photocathode will draw approximately 100 nanoamps of current for a bright source of 10 foot-candles.

Figure 2:
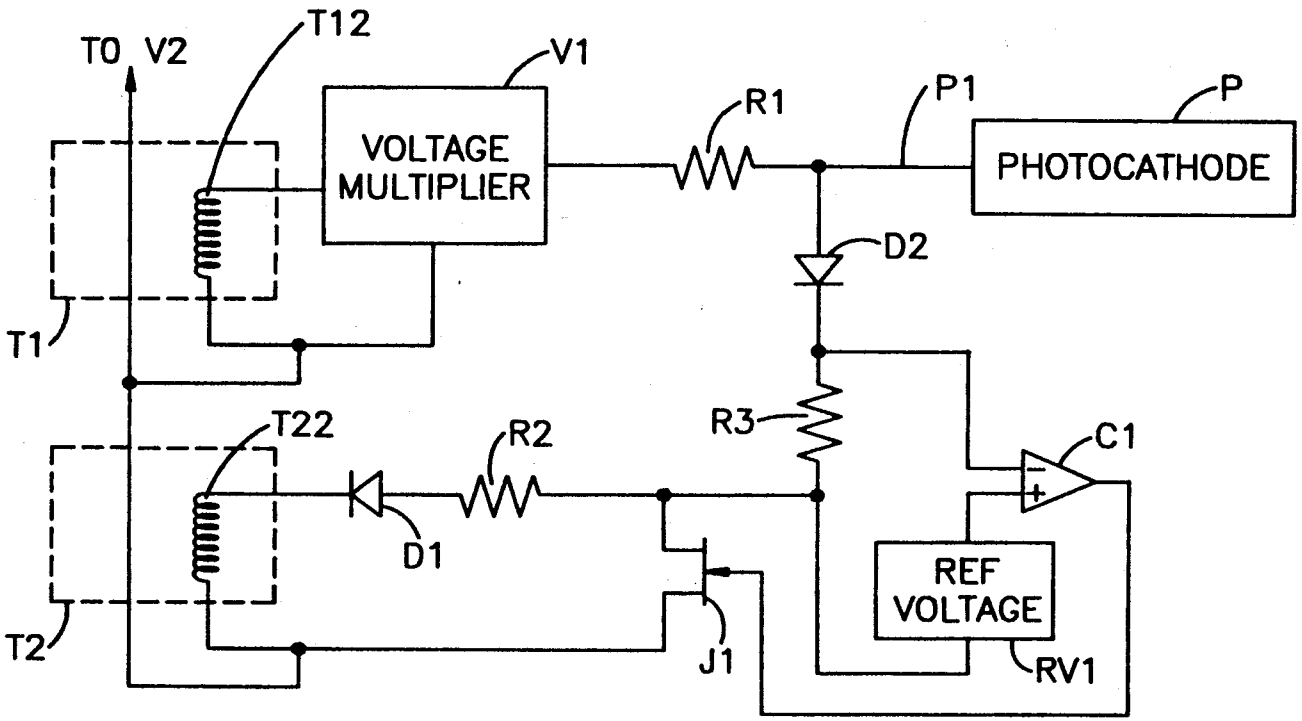
FIG. 2 is a schematic diagram of a bright source protection circuit in accordance with the present invention.

Referring now to FIG. 2, there is shown a bright source protection circuit in accordance with the present invention. Also shown is a photocathode P, a first voltage multiplier V1 and a first transformer T1 of the GEN III image intensifier tube. The secondary winding T12 of the first transformer T1 supplies 260 volts pk-pk to the first voltage multiplier V1 which, in turn, supplies the photocathode P with the operating potential of −1600 volts. The bright source protection circuit modulates the photocathode voltage such that the photocathode P is pulsed on and off until the desired photocathode current is obtained. The photo response remains constant. Ideally, the bright source protection circuit should modulate the photocathode voltage over a full range of illumination—between $10^{-6}$ and 20 foot-candles. However, it is not practical to change pulse duty cycle for each of seven orders of magnitude. Therefore, the bright source protection circuit in accordance with the present invention pulse width modulates the photocathode voltage over the higher order magnitudes ($10^{-2}$ to $10^{1}$ foot-candles), and employs the dropping resistor to reduce the photocathode voltage over the lower order magnitudes ($10^{-6}$ to $10^{-2}$ foot candles).

The dropping resistor is provided by a first resistor R1, which has a value of fifteen Gigaohms and is connected between the first voltage multiplier V1 and the input terminal P1 of the photocathode P. A ten nanoamp increase in current drawn by the photocathode P results in a fifteen volt drop across the first resistor R1. The decreased voltage at the input terminal P1 of the photocathode P reduces the photo response and thereby reduces the current drawn by the photocathode P.

When the current drawn by the photocathode exceeds a predetermined threshold, which threshold is indicative of brightness in the higher order magnitudes, the present invention begins to pulse width modulate the photocathode voltage. A half-wave rectifier supplies a power supply clamp voltage, which voltage is a negative half-wave of 40 volts peak. A secondary winding T22 of a second transformer T2 is connected in series with a first diode D1, a second resistor R2 and the drain-source path of the FET J1. A second transformer T2 is employed to supply the power supply clamp voltage instead of providing a tertiary winding on the first transformer T1. This prevents the second transformer T2 from affecting the operating potential supplied to the first voltage multiplier V1 by the first transformer T1. A reference potential is provided by the second multiplier V2. When the FET J1 is conductive, a half-wave is provided which alternates between zero volts and the power supply clamp voltage of 40 volts.

The anode of a second diode D2 is connected to the terminal P1 of the photocathode P, and a third resistor R3 is connected between the cathode of the second diode D2 and the second resistor R2. When the FET is gated on, the photocathode voltage is modulated between 0 and 40 volts. This causes the photocathode P to be pulsed off and on.

The FET J1 is controlled by a comparator C1, which samples the voltage across the third resistor R3. The output of the comparator C1 is coupled to the gate of the FET J1. The inverting input of the comparator C1 is coupled to the cathode of the second diode D2, and a reference voltage is coupled between the non-inverting input of the comparator C1 and the drain of the FET J1. The reference voltage is provided by a self-contained source RV1, which source RV1 can be implemented by a person skilled in the art. When the photocathode voltage is greater than the reference voltage, the FET J1 is gated off and operating potential is supplied to the photocathode P by the first voltage multiplier V1. When the photocathode voltage is less than the reference voltage, resulting from a large voltage drop across the first resistor R1 (i.e, indicative of a bright source), the FET J1 is gated on and the photocathode P is pulsed on and off by the half-wave rectifier until the desired current is drawn by the photocathode P. In this manner, the photocathode voltage is modulated between the power supply clamp voltage and zero volts.

The pulse duty cycle is controlled by adjusting the value of the third resistor R3 and the reference voltage such that the photocathode current in excess of the predetermined threshold will trigger the comparator C1 and energize the FET J1. These values and threshold can be derived without undue experimentation. The object is to reduce the "on" time of the photocathode P by a factor ranging between 2 and 1000. For example, a half-wave rectifier can be selected to provide a negative half wave of 60 volts at a period of 0.4 microseconds. If the first, second and third resistors R1, R2 and R3 can be selected at 15 Gigaohms, 10 megaohms and 1.5 megaohms, respectively, and the reference voltage can be selected at 1.5 volts, then one microamp of current will be equivalent to approximately 0.4 foot-candles of photocathode illumination.

Thus disclosed is a gated clamp voltage bright source protection circuit for an image intensifier tube. For high magnitudes of brightness, the photocathode voltage is modulated between a power supply clamp voltage and zero volts, thereby causing the tube to pulse off and on. This invention covers all schemes for bright source protection by photocathode voltage duty cycle control. Among the advantages offered by the present invention, resolution of the image intensifier tube is improved for a bright source, and current to the photocathode P is reduced.

It will be understood that the embodiment described herein is merely exemplary and that a person skilled in the art may make many variations and modifications without departing from the spirit and scope of the invention. All such modifications are intended to be included within the scope of the invention as defined in the appended claims.

We claim:

1. In an image intensifier tube having a photocathode, which draws a current in response to the brightness of input light, the improvement therewith comprising pulsing means, responsive to the magnitude current flowing through said photocathode, for pulsing said photocathode on and off only when said current drawn by said photocathode exceeds a predetermined value, indicative of a clamp level for said tube.

2. An image intensifier tube according to claim 1, wherein a predetermined threshold indicates bright input light, and wherein said pulsing means pulses said photocathode on and off when said current drawn by said photocathode crosses said predetermined threshold.

3. An image intensifier tube according to claim 2, wherein said current drawn by said photocathode is also a function of a photocathode voltage, wherein said image intensifier tube further includes voltage means, coupled to a terminal of said photocathode, for providing said photocathode with said photocathode voltage, and wherein said pulsing means is coupled to said terminal of said photocathode to modulate said photocathode voltage between a power supply clamp voltage and a secondary voltage when said current drawn by said photocathode crosses said predetermined threshold.

4. An image intensifier tube according to claim 3, wherein said image intensifier tube has a tube clamp voltage, wherein said power supply clamp voltage is greater than said tube clamp voltage, and wherein said secondary voltage is less than said tube clamp voltage.

5. The image intensifier tube according to claim 4, wherein said pulsing means includes pulse width modulating means, connected to said terminal of said photocathode, for pulse width modulating said photocathode voltage between said power supply clamp voltage and said secondary voltage.

6. An image intensifier tube according to claim 5, wherein the brightness of said input light ranges over several magnitudes and consists of a higher order magnitude and a lower order magnitudes, wherein said pulse width modulating means operates over said higher order magnitudes, and wherein said pulsing means further includes a resistor that operates on said lower order magnitudes, said resistor being connected between said voltage means and said terminal of said photocathode to drop the photocathode voltage at said terminal when said current drawn by said photocathode increases.

7. An image intensifier tube according to claim 6, wherein said pulse width modulation means includes:

actuatable power supply clamp means, connected to said terminal of said photocathode, for providing said photocathode with a voltage that alternates between said power supply clamp voltage and said secondary voltage when actuated;

determining means, for determining when said current provided by said photocathode crosses said predetermined threshold; and actuating means, coupled across said power supply clamp means and responsive to said determining means, for actuating said power supply clamp means.

8. An image intensifier tube according to claim 7, wherein said power supply clamp means is a half-wave rectifier.

9. An image intensifier tube according to claim 8, wherein said actuating means is an FET having its source-drain path coupled across said half-wave rectifier and its gate coupled to an output of said determining means.

10. An image intensifier tube according to claim 9, wherein said determining means includes a comparator having its output connected to said gate of said FET, its first input coupled to said terminal of said photocathode and its second input coupled to a source that provides a reference voltage.

11. In an image intensifier tube having a photocathode which draws a current in response to the brightness of input light and a photocathode voltage at an input terminal of said photocathode, an MCP having its input plane located in proximity of said photocathode, and a first voltage multiplier which provides operating potential to said input terminal of said photocathode, said MCP having a film on said input plane to create a tube clamp voltage, the improvement therewith comprising:

a resistor, coupled between an output of said first voltage multiplier and said input terminal of said photocathode; and pulse width modulating means, connected to said input terminal of said photocathode, for pulse width modulating said photocathode voltage between a power supply clamp voltage and a secondary voltage when said current drawn by said photocathode crosses a predetermined threshold, said secondary voltage being less than said tube clamp voltage, said power supply clamp voltage being greater than said tube clamp voltage, whereby said pulse width modulating means pulses said photocathode on and off.

12. An image intensifier tube according to claim 11, wherein said pulse width modulation means includes:

actuatable power supply clamp means, connected to said input terminal of said photocathode, for providing said photocathode with said photocathode voltage, which alternates between said power supply clamp voltage and said secondary voltage when actuated;

determining means, for determining when said current provided by said photocathode crosses said predetermined threshold, said predetermined threshold being indicative of bright input light; and actuating means, coupled to said power supply clamp means and responsive to said determining means, for actuating said power supply clamp means.

13. An image intensifier tube according to claim 12, wherein said actuatable power supply clamp means is a half-wave rectifier.

14. An image intensifier tube according to claim 13, wherein said actuating means is an FET having its source-drain path connected across said half-wave rectifier, and its gate coupled to an output of said determining means.

15. An image intensifier tube according to claim 14, wherein said determining means includes a comparator having its output connected to said gate of said FET, its first input coupled to said terminal of said photocathode and its second input coupled to a source that provides a reference voltage.

* * * * *